United States Patent [19]

Althaler et al.

[11] 4,302,133

[45] Nov. 24, 1981

[54] DEVICE FOR SUPPORTING A GALLERY OR A TUNNEL

[75] Inventors: Wilhelm Althaler, Vienna; Alfred Zitz, Zeltweg, both of Austria

[73] Assignee: Voest-Alpine Aktiengesellschaft, Vienna, Austria

[21] Appl. No.: 26,728

[22] Filed: Apr. 3, 1979

[30] Foreign Application Priority Data

May 31, 1978 [AT] Austria ..... 3963/78

[51] Int. Cl.[3] ..... E21D 15/44; E21D 19/00

[52] U.S. Cl. ..... 405/290; 405/288

[58] Field of Search ..... 405/288, 290, 291, 299; 299/33

[56] References Cited

U.S. PATENT DOCUMENTS 4,173,421 11/1979 Harhoff et al. ..... 405/291

FOREIGN PATENT DOCUMENTS 503016 5/1951 Belgium ..... 405/288

965845 6/1957 Fed. Rep. of Germany ..... 405/288

*Primary Examiner*—David H. Corbin

*Attorney, Agent, or Firm*—Cushman, Darby & Cushman

[57] ABSTRACT

The device for provisionally supporting a gallery or a tunnel which definitely shall be supported by support frames closed on all sides comprises a floor girder which servs as a part of the provisional frame as well as of the definite one. For the provisional support said floor girders are laid out separately near the mining face. Only U-shaped elements which are reduceable in profile are to be brought forward through the inner width of the positioned frames. These U-shaped elements may be connected with the said floor girders to form a complete provisional supporting frame closed on all sides. Such provisional support fulfills absolutely the safety requirements, and setting the definite frames may be carried out quickly and without long lasting interruptions of biasing the roof because the provisional floor girders remain usable as floor girders for the definite supporting frames, too.

6 Claims, 3 Drawing Figures

DEVICE FOR SUPPORTING A GALLERY OR A TUNNEL

This invention relates to a device for supporting a gallery or a tunnel drifted by means of a mining machine, such as a rotary cutting machine. The device comprises a temporary supporting frame having a cap-like central portion and two lateral legs hinged on said central portion and being adjustable in length by means of hydraulic cylinder and piston units. The U-shaped element formed by these legs together with the said cap-like portion can be reduced to a frame size narrower than the clear profile of the installed temporary frame but wider than the uttermost transverse profile of the mining machine.

A known device of that kind allows provisionally supporting the gallery by frames composed of a cap and two legs connected laterally with the same. In certain kinds of ground, however, a rock pressure is expected to act from all sides, and in this case the final supporting has to be accomplished by frames closed on all sides. Usually, such supporting was realized by so-called annular supports, i.e. by circular support frames which were all-round closed in themselves. In this case, however, a provisional support consisting only in a cap and two legs connected therewith includes a certain risk.

The present invention aims at eliminating such risk and is characterized essentially in that in galleries or tunnels whose permanent support requires frames closed on all sides, the provisional support frames are U-shaped elements whose free legs are connectable to each other by a floor girder which eventually may remain on the floor as a part of the permanent support. These floor girders are laid out near the mining face before the cutting machine. Since nothing but the U-shaped elements have to be transferred through the intermediate space between the machine and the already positioned provisional frames in the direction towards the mining face, this transportation is easily feasible, and the provisional open frames can be converted into closed support frames by connecting the vertical legs with the floor girder. Thus also the provisional frame absorbs the rock pressure acting from all sides, eliminating so any danger. Afterwards, the permanent support may be accomplished by all-round closed support frames of circular shape. In this case, it is necessary to cut out the mining face to a complete circular gallery profile. However, in order to obtain a plane floor for advancing the mining machine it is necessary to fill up again the lower segment cut out by the machine, this segment being superfluous in most cases for completing the gallery or tunnel. Now, the permanent support frames may be principally of the same type as the provisional ones so that there is no need for cutting out the lower segment of the circular profile. In this case, the floor girder may remain on the bottom to serve as a part of the permanent frame.

In a preferred embodiment of the invention the U-shaped element of the provisional support frame is divided at the roof center into two halves insertably joined together by a hydraulic cylinder and piston unit. Thus the requirements presumed for closed support frames are fulfilled, i.e. they can be urged from their sides too. The U-shaped portion of the provisional frame may define when put in its position a nearly exact circle shaped mining profile whilst any pressure exerted onto the side legs is absorbed in the roof portion by the said hydraulic unit and in the bottom portion by the said floor girder. This is an essential feature with an all-round closed support frame.

In another preferred embodiment, the floor girder is provided at its ends with upward projecting claws the upper ends of which are connectable with the free ends of the legs of the U-shaped definite support frames. The claws of two adjacent floor girders are connectable by longitudinal girders the central portion of which is in turn connectable with the free ends of the U-shaped portions of the provisional frames. If the floor girders remain on the bottom of the gallery, they become the lower portion of the permanent support frame. But a straight or only slightly curved floor girder is less resistant against a rock pressure coming from below than the curved portions of an all-round closed frame. Since the U-shaped portions of the permanent frame engage the upper ends of said claws, bending forces are generated in the floor girder which strive to arch the same downward, i.e. against the rock pressure exerted on the floor girder from below. Thus, relatively weakly dimensioned girders will be sufficient, the cross-section of which need not exceed the usual cross-section of tunnel or gallery arches. However, when drawing the provisional support frames, the open space should be secured already by the permanent frames, and since the U-shaped elements of the provisional frame are supported against the central portion of the longitudinal girders, it is possible to position the permanent frame already in the half structural distance of the provisional frames. It is useful to place the longitudinal girders following one another parallel to the axis of the gallery in such a position that they overlap one another in scales from below upwards while the ends of the longitudinal girders directed towards the mining face overlap the upper ends of the upward projecting claws and are secured against lateral displacement whilst the ends of the girders turned away from the mining face are joined to the lower portion of the claws. Thus, the connection point of the last floor girder which was set after the last permanent support frame in the direction toward the mining face remains free for being connected with the legs of the next definite support frame. That means that the provisional frame is to be drawn not until the permanent frame is already positioned in the half constructional distance behind the same. So the highest possible security is achieved since these longitudinal girders connected with the U-shaped elements of the provisional frames are secured against lateral displacement with respect to the floor girders, the said longitudinal girders and, consequently, the free legs of the U-shaped elements can withstand lateral rock pressure forces. So the provisional frames withstand the rock pressure nearly in the same manner as the permanent frames do.

Where a permanent gallery support of an about circular configuration is desired, it is easily possible to remove the floor girders for utilizing them when the following provisional support frame is built up.

The invention is schematically illustrated in the drawing which shows an embodiment by way of example.

The provisional support frame is drawn in full lines in its operational position. The dotted line gives the contour of the profile which has been reduced. 3 represents the outermost profile of the cutting machine.

Figure 3:
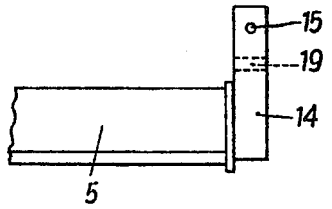
FIG. 3 shows a detail of the floor girder.

The provisional support frame comprises a U-shaped element 1 having free ends 4 which are connected to floor girders 5. The element 1 is composed of two arc-shaped elements 6 which are supported against one another about in the middle of the roof by a hydraulic unity which consists in a cylinder 7 and a piston 8. The piston 8 is shielded by a sheet metal cover 9. Lateral elements 11 are hinged onto the arc-shaped elements 6. Each lateral element 11 is provided with a hydraulic cylinder and piston unit 12/13. So the side elements 11 can be extended like props. The floor girders 5 are provided on their ends with upward projecting claws 14 (see FIG. 3). On the upper ends of these claws there are bores 15. Bolts insertable into these bores may connect the floor girder to the lower end of the definite support frame, if an analogous size is selected for the latter. Thus, a support frame is generated which is closed from all sides.

With the proceeding of cutting and mining, the provisional frames must be transferred forward to the mining face. To enable such transportation without obstacles caused by the frames already positioned and by the mining machine itself, the provisional frames are reduced in size, as shown in dotted lines 1' in FIG. 1 so that they can be transported between the machine 3 and the frames already positioned. For this purpose, the piston 8 is retracted into the cylinder 7 so that the arc-shaped elements 6 come into the position 6', and the side elements 11 come into the position 11'. By doing so, each time the last frame behind the rear end of the mining machine 3 is drawn and reduced to the configuration 1' and then positioned before the mining face. When the frame is being set a pressure fluid acting on the piston 8 is introduced into the cylinder 7. The side elements 11 are pivoted outwards and fixed in their outer position by inserting bolts 16. Also the two cylinders 12 are pressurized so that the free ends 4 can be connected with the floor girders 5.

Figure 2:
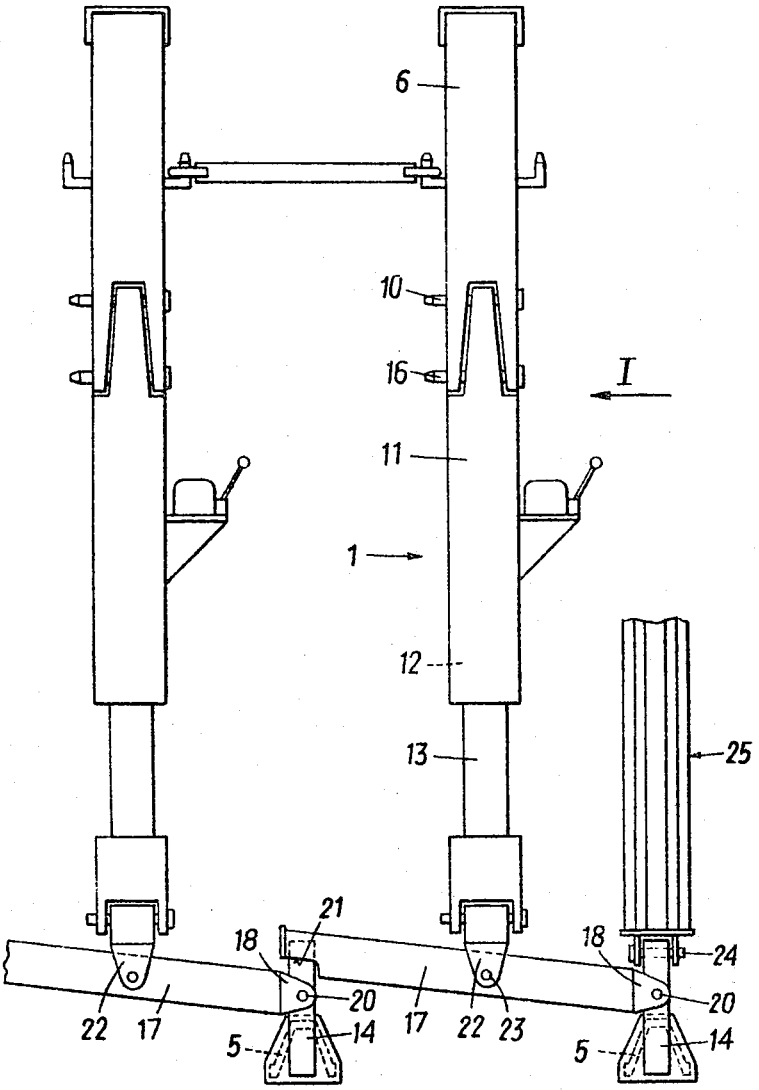
FIG. 2 is a side view taken in the direction of the arrow II of FIG. 1.

The manner how the ends 4 are connected to the girders 5 is shown in FIG. 2. There are provided longitudinal girders 17. The end 18 of the said girder directed away from the mining face is bifurcated and straddles the claw 14. A bolt 20 penetrates the girder and a bore 19 provided in said claw 14. The longitudinal girder 17 is tubular. At its end facing the mining front it has a recess 21 enabling the longitudinal girder 17 to be put onto the claw 14 of the floor girder 5 lying nearer to the mining front. Thus, the longitudinal girder is secured on its both ends against transversal displacement. Consequently, it serves as an abutment for the free leg 4 of the U-shaped element 1. In the middle portion of the longitudinal girder there is provided a transverse bore whilst the legs 4 are bifurcated as shown at 22. The girder is engaged by the bifurcated leg and joined to the same by a bolt 23. By this arrangement the upper end of the claw 14 of the girder 5 which is more distant from the mining face remains free for being connected by means of a bolt 24 to the permanent frame. The lower end of the frame 1 is marked as 25. So the permanent support frame can be positioned in the half structural distance from the provisional frame before the latter has been removed. The U-shaped elements are brought onward in a reduced form as marked 1' by a transportation device (not shown).

Figure 1:
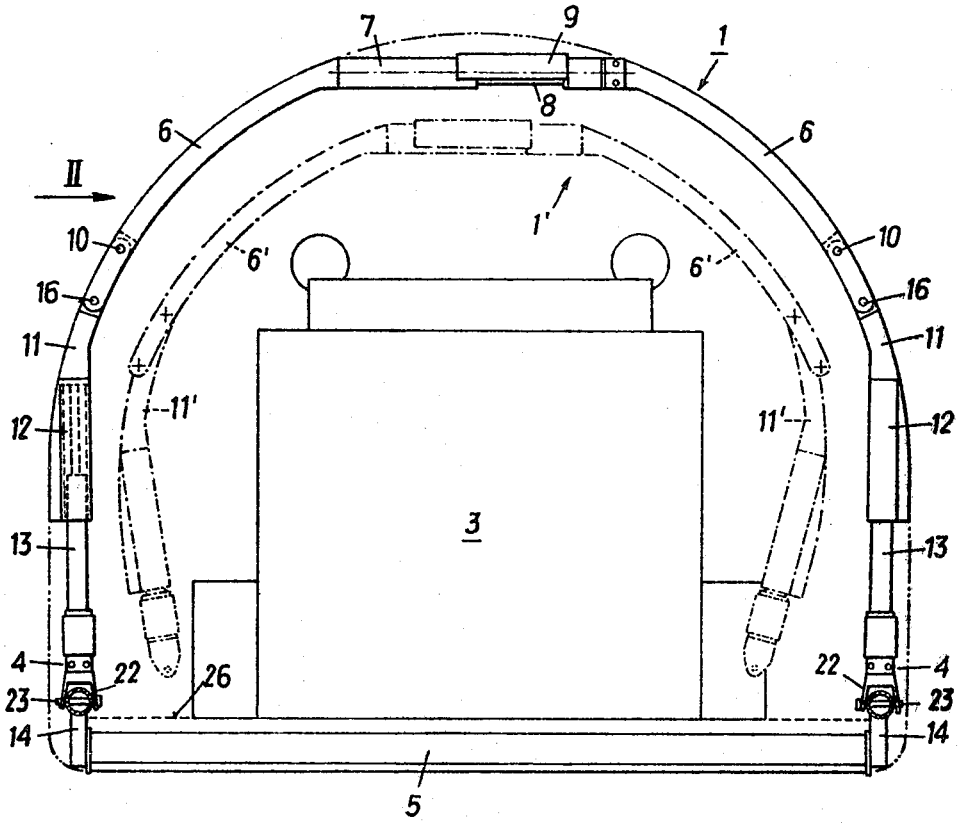
FIG. 1 shows a provisional support frame viewed in the direction towards the mining face, i.e., in the direction of the arrow I of FIG. 2.

If the permanent support frame has an analogous profile consisting in a U-shaped element and a floor girder, the rock has to be cut out not wider than defined by the dotted line in FIG. 1. Thereupon, the floor has to be filled up slightly higher than the level of the floor girder, i.e. approximately until the line 26 to achieve a moving level for the cutting machine. On the other hand, it remains possible setting circle-formed supporting frames. In this case, the cutting machine must cut a circular profile after the provisional frames have been removed. Of course, an essentially greater portion of the profile must be refilled to obtain an advancing basis for the machine.

We claim:

1. Apparatus for supporting a gallery or tunnel drifted by a mining machine comprising: a plurality of longitudinally-spaced provisional support frames, each including a cap-like central portion and two side elements hinged on the central portion and adjustable in length by means of a cylinder and piston unit, the central portion and side elements forming a U-shaped frame which is reduceable from an expanded condition to a frame size narrower than the inner width of a previously positioned expanded provisional support frame; a plurality of transverse floor girders each having opposite ends, the opposite ends of at least one girder being releasably connected to the lower ends of the side elements of a provisional support frame; and at least one permanent U-shaped support frame supporting the roof of the gallery, said permanent support frame having side elements the lower ends of which are connected to the ends of a transverse floor girder from which a provisional support frame has previously been disconnected.

2. Apparatus as in claim 1 wherein said floor girder is provided at its ends with upward projecting claws whose upper ends have connecting points for said side elements.

3. Apparatus as in claim 2 wherein said connecting points are constructed as bores transversing the claws and receiving connecting bolts.

4. Apparatus as in claim 2 including longitudinal girders, the claws of two adjacent floor girders being connected with each other by a longitudinal girder, said longitudinal girders including means located at the central portion thereof for connecting the free ends of the side elements of a provisional frame.

5. Apparatus as in claim 4 wherein the longitudinal girders are arranged following one after another within the gallery or tunnel and are arranged in a sloping position such that their ends directed toward the mining face overlap the upper ends of two of said upward projecting claws whilst their opposite ends are joined to the lower portion of two other of said claws, and wherein by this arrangement the longitudinal girders are secured against lateral displacement.

6. A method for supporting a gallery or tunnel having a mining face being cut by a mining machine, using provisional and permanent support frames, said provisional frames each including a U-shaped assembly having two legs and which can be reduced in size, said method comprising: laying out between the mining machine and the mining face a plurality of floor girders extending transverse to the longitudinal dimension of the tunnel and releasably connecting the legs of a plurality of provisional support frames to the ends of respective floor girders; disconnecting the legs of one of said provisional support frames which is situated at the greatest distance from the mining face from its respective floor girder; reducing the size of such frame; passing the reduced frame through at least one previously expanded second provisional support frame which has its legs releasably connected to the ends of a floor girder; releasably connecting the legs of the reduced support frame to a floor girder near the mine face and expanding such frame; and connecting the lower ends of the legs of a permanent U-shaped support frame to a floor girder from which a provisional support frame was disconnected.

* * * * *